US008403694B2

(12) United States Patent
Xiao et al.

(10) Patent No.: US 8,403,694 B2
(45) Date of Patent: Mar. 26, 2013

(54) SOCKET CONNECTOR PROVIDED WITH COVER ROTATABLY MOUNTED ON BASE

(75) Inventors: Yu-Bao Xiao, Shenzhen (CN); Wen He, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 67 days.

(21) Appl. No.: 13/181,528

(22) Filed: Jul. 13, 2011

(65) Prior Publication Data

US 2012/0015540 A1 Jan. 19, 2012

(30) Foreign Application Priority Data

Jul. 13, 2010 (CN) ..... 2010 2 0256344

(51) Int. Cl.
*H01R 13/625* (2006.01)

(52) U.S. Cl. ..... 439/342; 439/259; 439/266

(58) Field of Classification Search ..... 439/259, 439/263, 266, 342
See application file for complete search history.

(56) References Cited

U.S. PATENT DOCUMENTS

| | | | | |
|---|---|---|---|---|
| 6,319,032 | B1 * | 11/2001 | Carrel et al. | 439/259 |
| 7,001,198 | B2 | 2/2006 | He et al. | |
| 2012/0015540 | A1 * | 1/2012 | Xiao et al. | 439/342 |

* cited by examiner

*Primary Examiner* — James Harvey
(74) *Attorney, Agent, or Firm* — Wei Te Chung; Ming Chieh Chang

(57) ABSTRACT

A socket connector for electrically connecting a PGA package comprises a base having at least one passageway therein, at least one contact received in the at least one passageway and a cover rotatably mounted on the base and having at least one through hole corresponding to the passageway. The socket connector has a simple structure.

20 Claims, 9 Drawing Sheets

SOCKET CONNECTOR PROVIDED WITH COVER ROTATABLY MOUNTED ON BASE

BACKGROUND OF THE INVENTION

1. Field of the Invention

The present invention relates to a socket connector, and more particularly to a socket connector provided with cover rotatably mounted on a base so as to establish electrical connection simply.

2. Description of Prior Art

PGA (Pin Grid Array) type socket connector is widely used in a computer system for electrically connecting a PGA package to a motherboard. A typically PGA socket connector generally comprises a base having a plurality of contacts received therein, a cover slideably mounted on the base and having a number of through holes corresponding to the contacts received in the base, and a cam received between the base and cover for driving the cover to slide between a first position and a second position relative to the base. When the cover is at the first position, the PGA package is mounted on the cover and pins of the PGA package are inserted through the through holes of the cover. Then, the cam is turned so as to drive the cover. During sliding movement of the cover from the first position to the second position, the pins will be slide and electrically connecting with the contacts of the base when the cover arrives the second position.

However, such conventional PGA socket connectors need a cam to drive the cover. Thus, structure of the socket connector is complicated. Additional, when the cam is turned, the cover will face a risk of whirling. Accordingly, electrical connection between the pins and the contacts will be affected.

In view of the above, a socket connector with improved standoff-equipped stiffener that overcomes the above-mentioned disadvantages is desired.

SUMMARY OF THE INVENTION

Accordingly, an object of the present invention is to provide a socket connector provided with cover rotatably mounted on a base so as to establish electrical connection simply.

To achieve the above-mentioned object, a socket connector for electrically connecting a PGA package comprises a base having at least one passageway therein, at least one contact received in the at least one passageway and a cover rotatably mounted on the base and having at least one through hole corresponding to the passageway. PGA package can be rotated relative to the base and electrical connection between pin of the PGA package and contact of the base will be established after rotary motion of the PGA package is finished. The socket connector of the present invention does not need a cam therein and has a simple structure and a lower cost.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Figure 1:
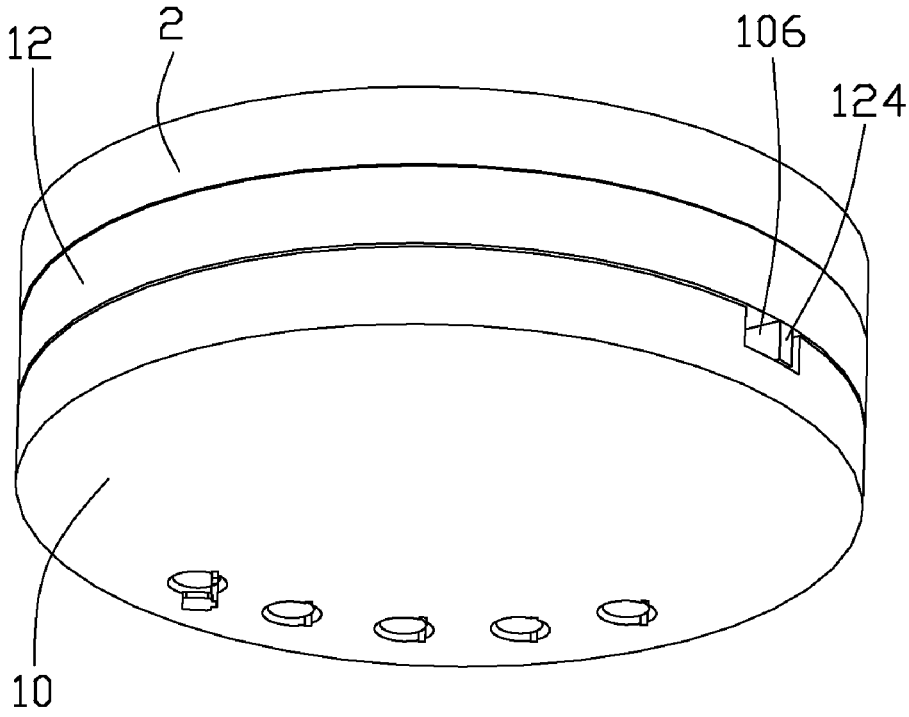
FIG. 1 is an isometric, assembled view of a socket connector and a PGA package in accordance with a preferred embodiment of the present invention.

Reference will now be made to the drawings to describe the present invention in detail.

Referring to FIGS. 1-9, the socket connector 1 of the present invention is used for electrically connecting a PGA package 2 to a motherboard (not shown), comprising a base 10, a cover 12 mounted on the base 10, at least one contact 14 received in the base 10. Both the base 10 and cover 12 are formed of a shape of cylinder and having equal cross section. The base 10 defines an upper surface 100 having a dowel pin 104 at a central portion thereof. The cover 12 defines a bottom surface having an opening 122 corresponding to and rotatably receiving the dowel pin 104, so as to ensure the cover 12 able to be rotated relative to the base 10 around the dowel pin 104. The base 10 defines at least one passageway 102 for receiving the at least one contact 14.

Figure 2:
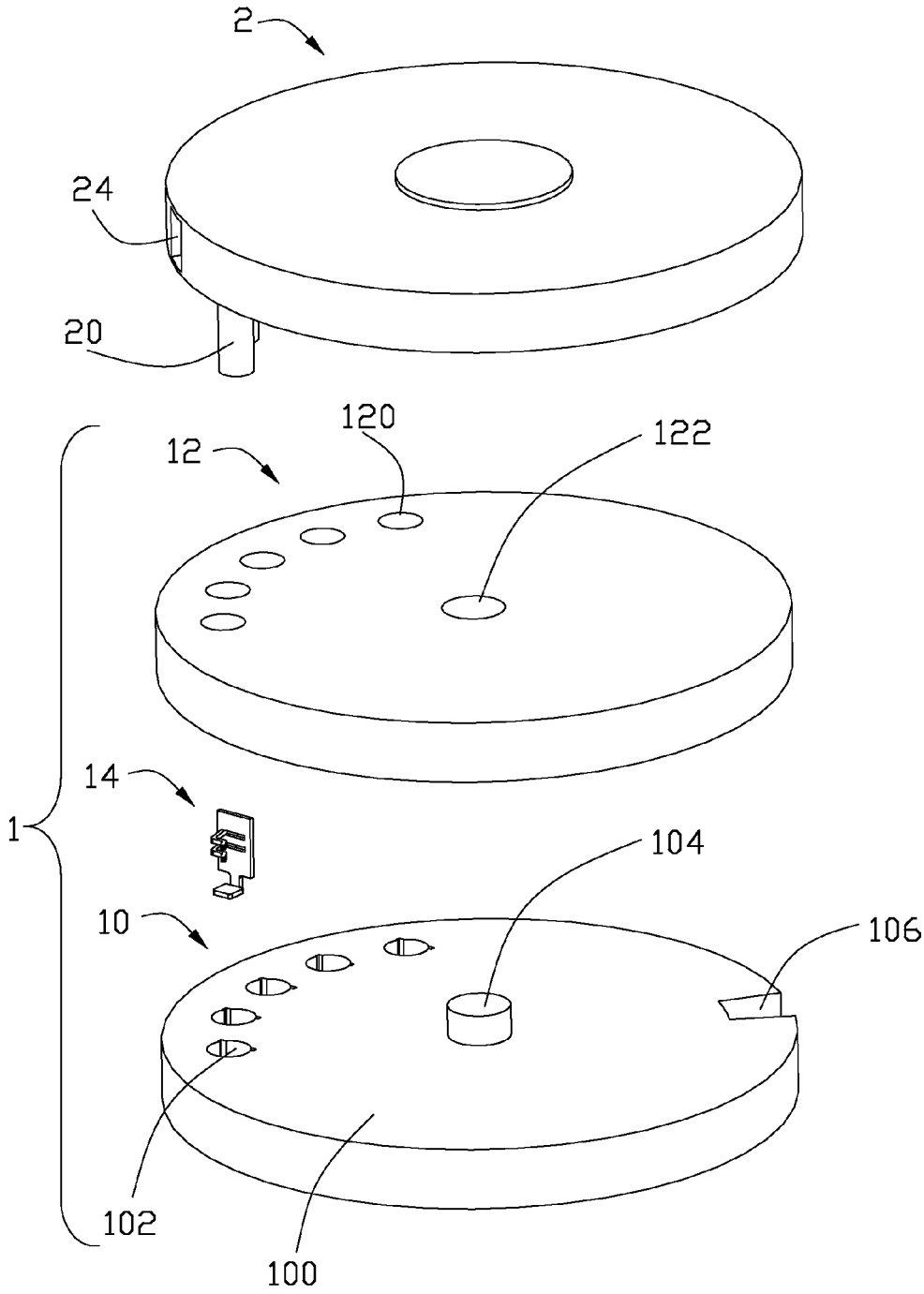
FIG. 2 is an isometric, exploded view of the assembly as shown in FIG. 1.
Figure 3:
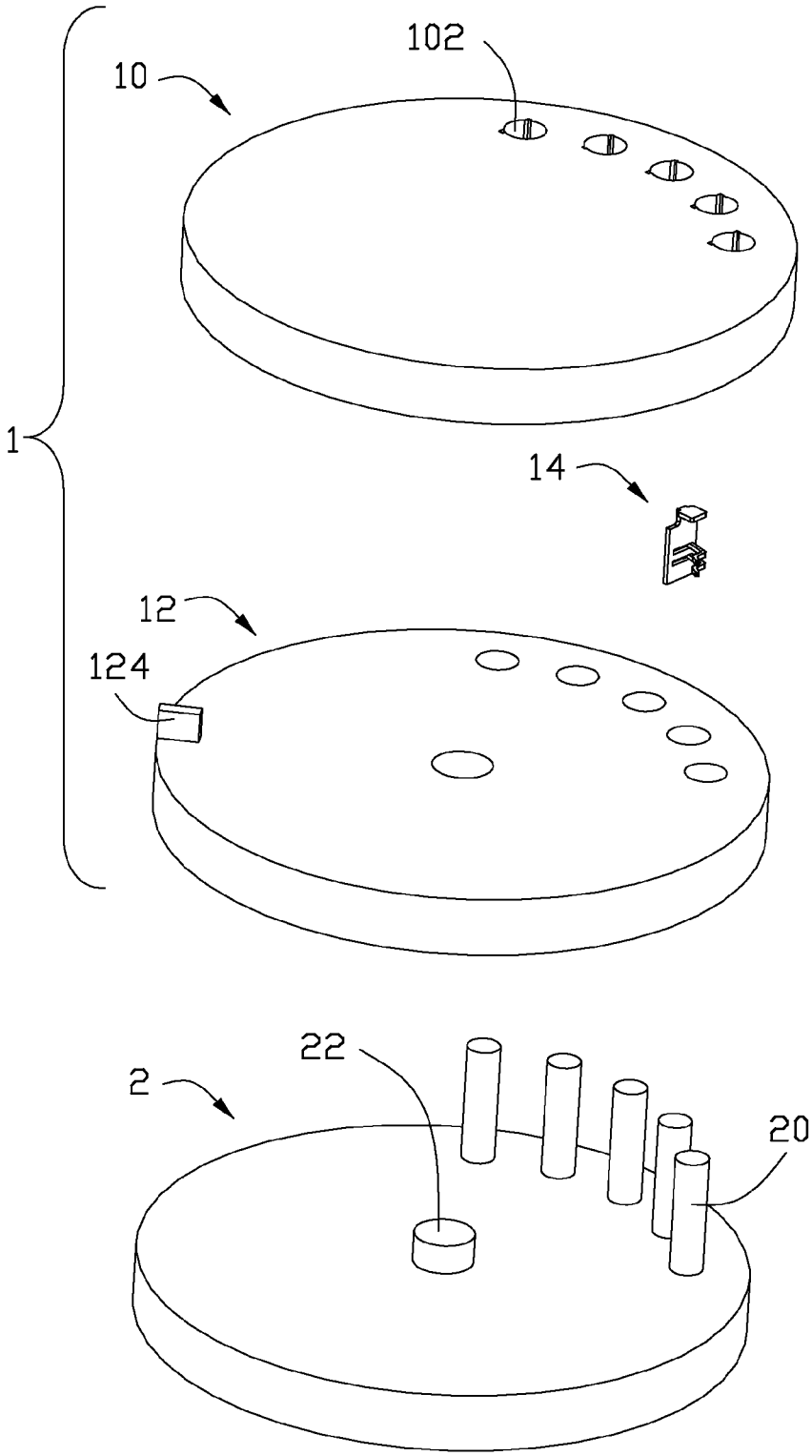
FIG. 3 is an isometric, exploded view of the assembly as shown in FIG. 1 from another view.
Figure 4:
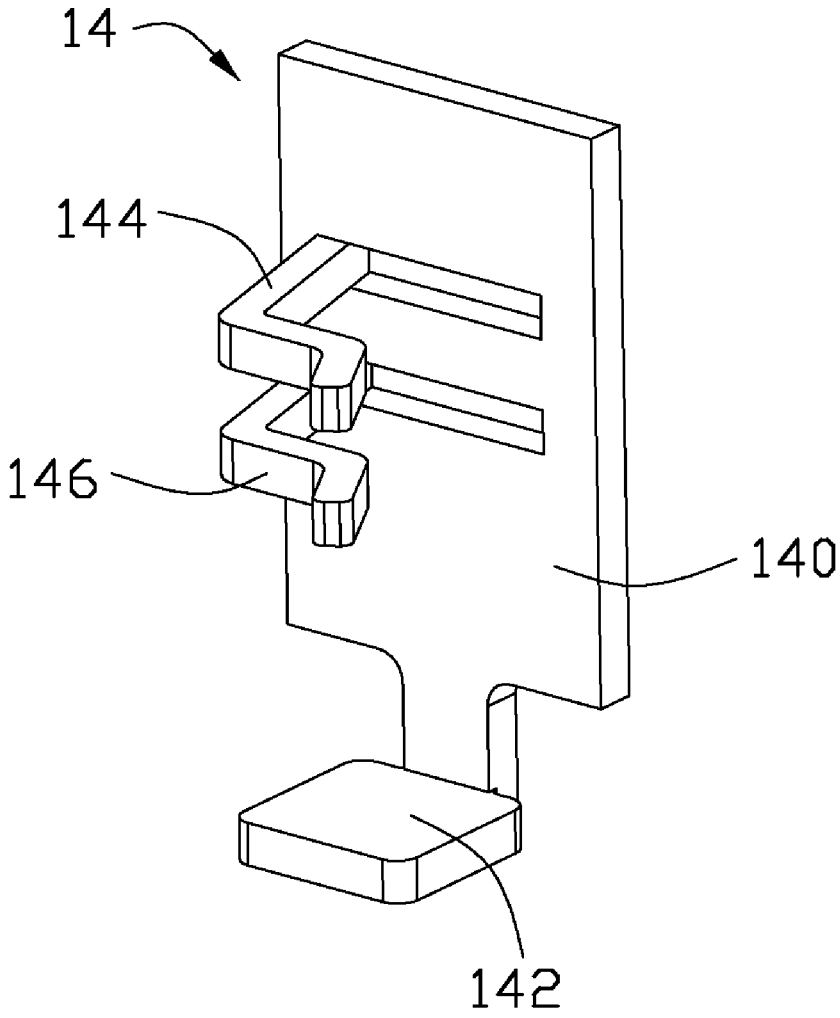
FIG. 4 is an isometric view of the contact of the socket connector.
Figure 5:
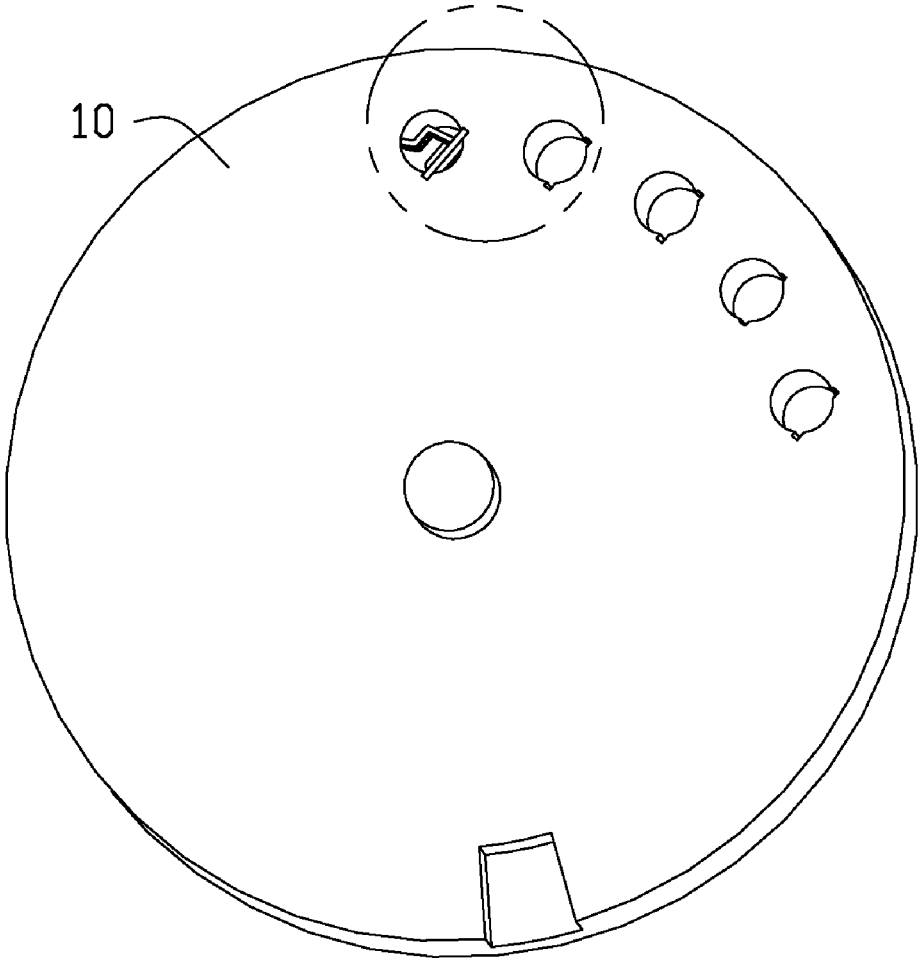
FIG. 5 shows status of a contact received in the socket connector.
Figure 6:
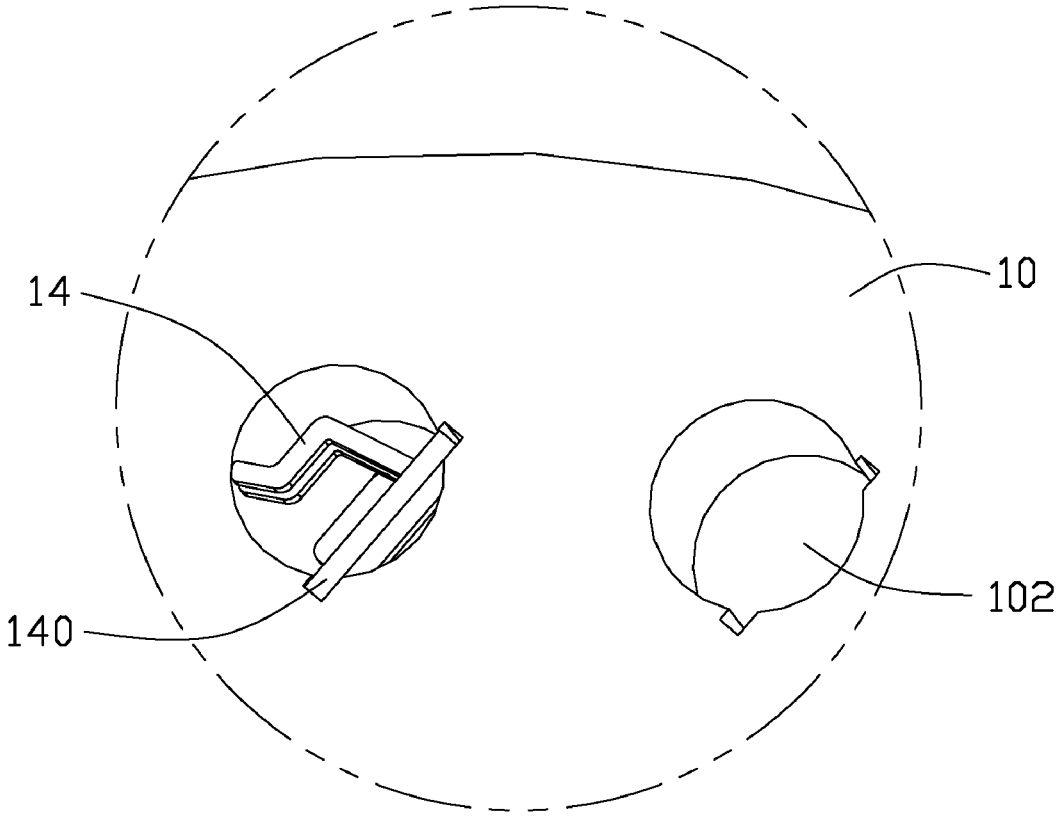
FIG. 6 is an enlarged view of the X labeled portion shown in FIG. 5.
Figure 7:
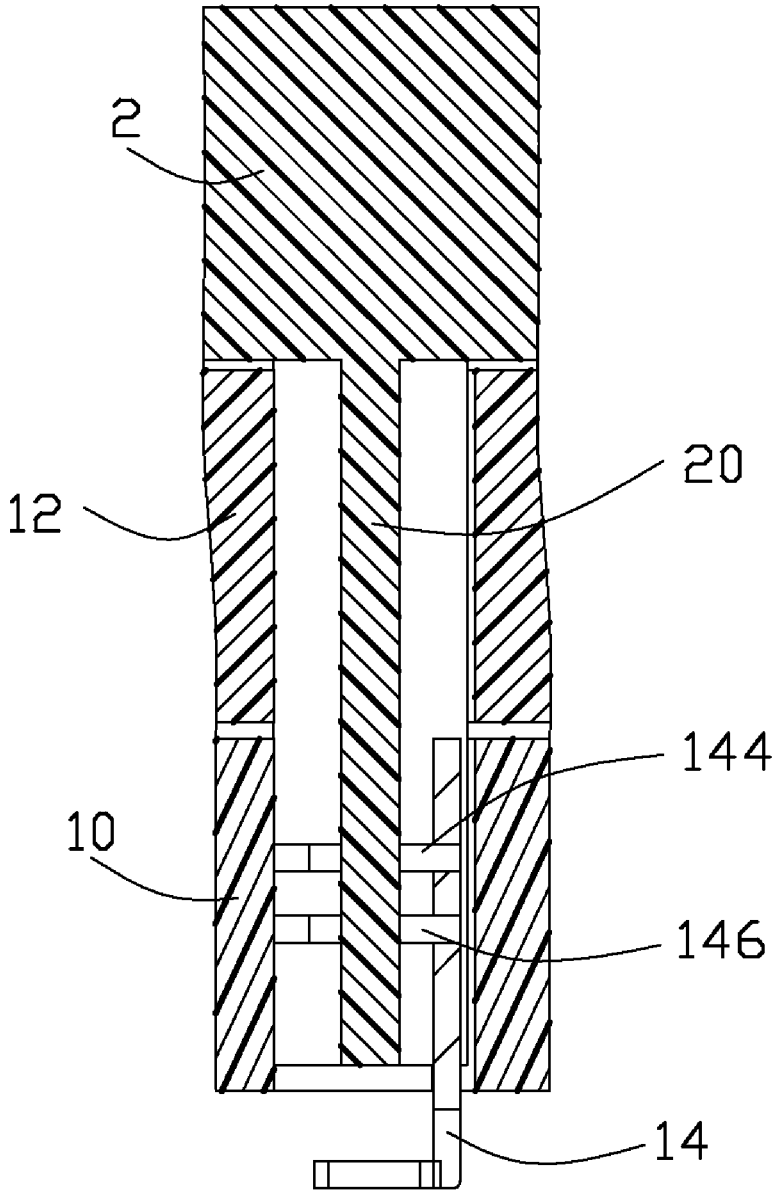
FIG. 7 is a cross-sectional view of the assembly shown in FIG. 1.

Referring to FIGS. 2-3, the cover 12 defines at least one through hole 120 corresponding to the passageway 102. The cover 12 defines a post 124 extending downwardly from the bottom surface of the cover 12, and the base 10 defines a slot 106 corresponding to the post 12. After the cover 12 is assembled with the base 10 and rotated relative to the base 10 around the dowel pin 104, the slot 106 will limit range of rotary motion of the cover 12 relative to the base 10. In this embodiment, the slot 106 is recessed from cylindrical surface of the base 10.

Referring to FIGS. 4-9, the contact 14 comprises a vertical retaining portion 140 engageable with inner wall of the passageway 102, a solder portion 142 extending from a bottom end of the retaining portion 140, and a pair of contacting arms 144, 146 extending from the retaining portion 140, which are split from main portion of the retaining portion 140. The contacting arms are disposed spaced to each other in vertical direction. A space is defined between the contacting arms and inner wall of the passageway 102 thus ensuring a pin 20 of the PGA package 2 to be inserted and received therein.

Referring to FIG. 3, the PGA package 2 is of a shape of cylinder. The pins 20 extending downwardly from a bottom face of the PGA package 2 corresponding to the through hole 120 of the cover 12. Additional, the PGA package 2 defines a positioning post 22 received in the opening 122. After the PGA package 2 is mounted onto the cover 12, pins 20 will pass through the through holes 120 and be inserted into the passageway 102.

Figure 8:
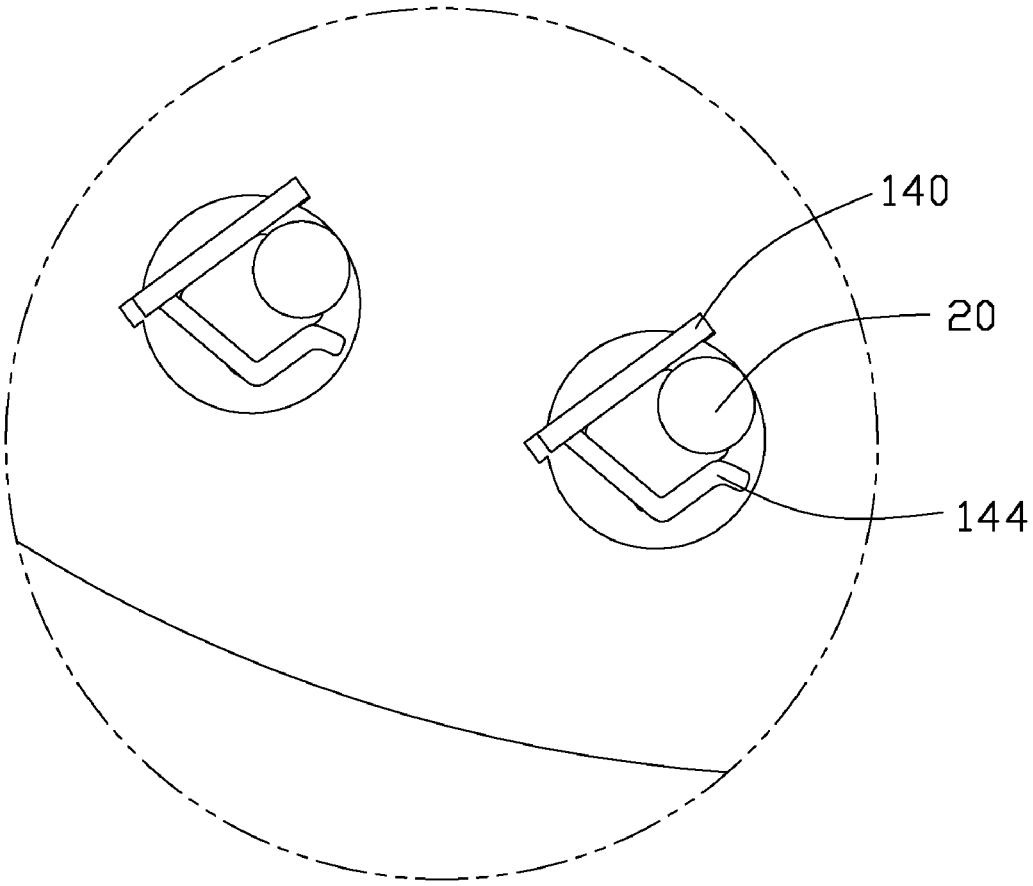
FIG. 8 is a partially cross-sectional view of the assembly shown in FIG. 1, wherein a contact does not engage with a pin of the PGA package.
Figure 9:
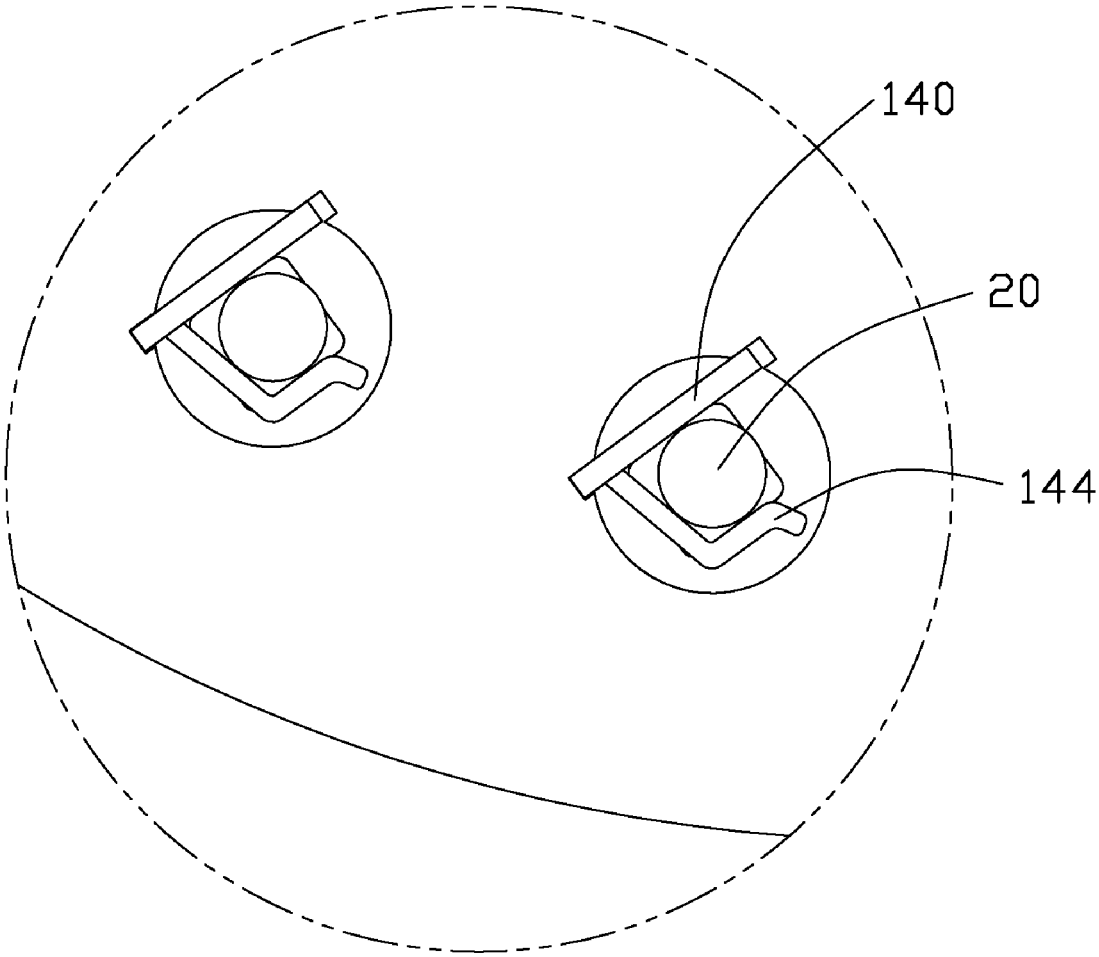
FIG. 9 is a partially cross-sectional view of the assembly shown in FIG. 1, wherein the contact engages with the pin of the PGA package.

When the cover 12 is rotated relative to the base 10, the PGA package 2 will be rotated together because inter-engagement is formed between the PGA package 2 and the cover 12. Rotary motion of the cover 12 relative to the base 10 can be achieved by several manners. In this embodiment, a recess 24 is formed on cylindrical surface of the PGA package 2 able to be operated by a screwdriver (not shown). Of course, the recess 23 can be disposed on cylindrical surface of the cover. Accordingly, when operator uses a screwdriver to drive the PGA package 2, the cover 12 will be rotated relative to the base 10. Referring to FIG. 8, pin 20 does not contact with the contact 14 before the cover 12 is rotated, and referring to FIG. 9, pin 20 contacts with the contact after the cover 12 is rotated. During rotary movement of the cover 12 relative to the base 10, contacting area between the upper surface 100 of the base 10 and the bottom surface of the cover 12 is constant.

The cover 12 of the present invention can be rotated relative to the base 10. Therefore, PGA package 2 can be rotated relative to the base 10 and electrical connection between pin 20 of the PGA package 2 and contact 14 will be established after rotary motion of the PGA package 2 is finished. The socket connector 1 of the present invention does not need a cam therein and has a simple structure and a lower cost.

While the preferred embodiment in accordance with the present invention has been shown and described, equivalent modifications and changes known to persons skilled in the art according to the spirit of the present invention are considered within the scope of the present invention as defined in the appended claims.

What is claimed is:

1. A socket connector for connecting a PGA package having at least one downward pin, comprising:

a base having at least one passageway therein;

at least one contact received in the at least one passageway;

a cover rotatably mounted on the base and having at least one through hole corresponding to the passageway, the cover being adapted to have the PGA package mounted thereon with the pin passing through the through hole and into the passageway; and the cover being rotated through a range to promote the pin to be engaged with or disengaged from the contact.

2. The socket connector as claimed in claim 1, wherein the at least one contact comprises a retaining portion for engaging with inner wall of the passageway, a pair of contacting arms extending from the retaining portion.

3. The socket connector as claimed in claim 1, wherein the base defines an upward dowel pin, and the cover defines an opening corresponding to the dowel pin, so as to ensure the cover rotatably mounted on the base.

4. The socket connector as claimed in claim 3, wherein the cover defines a downward post, and the base defines a slot cooperated with the post for limiting range of rotary motion of the cover relative to the base.

5. The socket connector as claimed in claim 4, wherein both the base and cover are of a shape of cylinder.

6. The socket connector as claimed in claim 5, wherein the slot is recessed from cylindrical surface of the base.

7. The socket connector as claimed in claim 5, wherein the dowel pin is formed at a central portion of an upper face of the base, and the opening of the cover is formed at a central portion of the cover.

8. The socket connector as claimed in claim 5, wherein cylindrical surface of the cover defines a recess adapted to be operated by a screwdriver.

9. A socket connector, comprising:

a base having at least one passageway therein and an upper surface;

at least one contact received in the at least one passageway;

a cover moveably mounted on the base having at least one through hole corresponding to the passageway and defining a lower surface seated on the upper surface of the base; and wherein during movement of the cover relative to the base, a contacting area between the upper surface of the base and the lower surface of the cover is constant.

10. The socket connector as claimed in claim 9, wherein the cover is rotatably mounted onto the base.

11. The socket connector as claimed in claim 10, wherein the at least one contact comprises a retaining portion for engaging with inner wall of the passageway, a pair of contacting arms extending from the retaining portion.

12. The socket connector as claimed in claim 11, wherein the base defines an upward dowel pin, and the cover defines an opening corresponding to the dowel pin, so as to ensure the cover rotatably mounted on the base.

13. The socket connector as claimed in claim 10, wherein the cover defines a downward post, and the base defines a slot cooperated with the post for limiting angle of rotary motion of the cover relative to the base.

14. The socket connector as claimed in claim 13, wherein both the base and cover are formed of a shape of cylinder.

15. The socket connector as claimed in claim 13, wherein the slot is recessed from cylindrical surface of the base.

16. The socket connector as claimed in claim 13, wherein cylindrical surface of the cover defines a recess adapted to be operated by a screwdriver.

17. A socket assembly comprising:

an immoveable base defining a plurality of passageways therein;

a plurality of contacts disposed in the corresponding passageways, respectively;

a cover defining a plurality of through holes essentially in alignment with the corresponding passageways, respectively, said cover mounted upon the base and moveable relative to the base about a reference axis; and an electronic package mounted upon the cover and moveable along with the cover; wherein pins of the electronic package extend respectively through the corresponding through holes and into the corresponding passageways to engage the corresponding respective contacts under condition that during movement along with the cover, displacements of said pins of the electronic package vary based upon distances spaced from the axis.

18. The socket assembly as claimed in claim 17, wherein said axis is located at a center of the base and a center of the cover.

19. The socket assembly as claimed in claim 18, wherein the contacts are symmetrically arranged with one another around the axis.

20. The socket assembly as claimed in claim 17, wherein said axis is located at a center of the electronic package.

* * * * *